US005538459A

United States Patent [19]

Gottschald et al.

[11] Patent Number: 5,538,459

[45] Date of Patent: Jul. 23, 1996

[54] PROCESS FOR MEASURING FORWARD AND REARWARD THREE-DIMENSIONAL CURVES AND THICKNESS OF A CORRECTIVE LENS

[75] Inventors: Lutz Gottschald, Meerbusch; Klaus Eickmeyer, Haan, both of Germany

[73] Assignee: Wernicke & Co. GmbH, Germany

[21] Appl. No.: 389,068

[22] Filed: Feb. 14, 1995

Related U.S. Application Data

[63] Continuation of Ser. No. 32,623, Mar. 17, 1993, abandoned.

[30] Foreign Application Priority Data

Mar. 19, 1992 [DE] Germany ..... 42 08 835.6

[51] Int. Cl.[6] ..... B24B 17/00; B24B 9/14

[52] U.S. Cl. ..... 451/11; 451/43; 451/240; 451/255; 451/256

[58] Field of Search ..... 451/42, 43, 11, 451/9, 240, 255, 256

[56] References Cited

U.S. PATENT DOCUMENTS 4,596,091 6/1986 Dabou et al. ..... 51/101 LG
4,638,601 1/1987 Steere et al. ..... 51/165.71
4,964,239 10/1990 Gottschald et al. ..... 51/101 LG
5,321,915 6/1994 Lecerf et al. ..... 51/101 LG

FOREIGN PATENT DOCUMENTS 433114 6/1991 European Pat. Off. .

*Primary Examiner*—Jack W. Lavinder
*Attorney, Agent, or Firm*—Ostrolenk, Faber, Gerb & Soffen

[57] ABSTRACT

A process for measuring forward and rearward three-dimensional curves and the thickness at the circumference of a contour-ground eyeglass lens by means of a computer-controlled eyeglass lens edge grinding machine. As the corrective lens is being ground, the rotation of the corrective lens is interrupted when a measurement point is reached, and the corrective lens is shifted axially relative to the grinding disk away from the center section and toward the edges of the grinding disk until the forward and rearward edges at the circumference of the corrective lens touch the tracing device. The path or the time consumed in moving from the center section to the point of contact with the tracing device is recorded, and the measured values are stored in the computer, the shaft halves holding the corrective lens rotate further, until the next measurement point is reached, when a measurement is again taken. The process is continued until the shaft halves holding the corrective lens have completed at least one full revolution. This type of measurement value acquisition avoids errors due to very severe concavity in very thick lenses.

9 Claims, 1 Drawing Sheet

PROCESS FOR MEASURING FORWARD AND REARWARD THREE-DIMENSIONAL CURVES AND THICKNESS OF A CORRECTIVE LENS

This is a Continuation of application Ser. No. 08/032,623 filed on Mar. 17, 1993 now abandoned.

BACKGROUND OF THE INVENTION

The present invention relates to a process and apparatus for measuring forward and rearward three-dimensional curves and thickness of a corrective eyeglass lens while contour-grinding the circumference of a corrective lens and for using the measured values to grind a bevel or groove by means of a computer-controlled corrective lens edge grinding machine.

Described in German patent specification 38 42 601, held by the present applicant, and corresponding to U.S. Pat. No. 4,964,239, is a computer-controlled corrective lens edge grinding machine featuring shaft halves holding the corrective lens and an edge grinding disk which shapes the circumference of the lens along with a tracing device near the circumference of the corrective lens to measure the three-dimensional curves and the thickness of the lens, this tracing device being connected to a computer. The tracing device has arms situated in a fork-like arrangement one with respect to another and parallel to the plane of the grinding disk and positioned at a distance one to the other corresponding approximately to the width of the grinding disk. The shaft halves holding the corrective lens or the grinding disk and the tracing device execute reciprocating movements which exhibit either a constant amplitude with a minimum value corresponding to the distance between the arms or reciprocating movements the amplitude of which is determined by the contact of the corrective lens with the arm in each case, whereby the path covered is measured either directly or by way of the time consumed by the movement of the corrective lens or the grinding disk to and fro between a fixed reference plane and the reversing points for the reciprocal movement.

In this corrective lens contour-grinding machine, the corrective lens held between the shaft halves rotates continuously or stepwise during the grinding process, continuing even when the corrective lens is in the area near the edge of the grinding disk and in contact with one of the arms of the tracing device. If the pre-ground blank which already exhibits approximately the ultimate contour at the circumference exhibits severe concavity, which can easily be the case when dealing with very thick lenses and certain eyeglass frame shapes, then the measured values will be inaccurate. This can result, on the one hand, from the fact that, due to the concavity, the point of contact between the circumference of the corrective lens and the tracing device is not at the point where the corrective lens is in contact with the grinding disk and, on the other hand, may result from the fact that in the course of the further rotation of the shaft halves with the corrective lens in contact with the tracing device, there is already a considerable change in the thickness and/or in the three-dimensional curve at the forward or rearward face of the corrective lens. The result is that the location of a bevel or groove applied after final grinding of the corrective lens contour using computer-controlled edge grinding with a suitably profiled grinding disk cannot be determined ideally so that high-quality corrective lenses cannot be manufactured which fit perfectly in the selected eyeglass frames and offer an aesthetically favorable appearance.

SUMMARY OF THE INVENTION

It is an object of the present invention to provide a process and apparatus for grinding the circumference of a corrective lens and to trace the three-dimensional curves and the thickness of the contoured corrective lens which avoids measurement errors, particularly in very thick lenses with severe concavity, and which perform these functions with the fewest possible measurement points.

The above and other objects are achieved by the present invention. According to the invention, in a process of the type mentioned at the outset, the rotation of the corrective lens during contour-grinding is interrupted at pre-determinable angular intervals, the corrective lens is shifted axially relative to the grinding disk, and, by recording the path or the time required for this shifting, the location of the forward and rearward three-dimensional curves and the thickness are determined at these measurement points.

Observed in detail, the contour-grinding of the circumference of the corrective lens takes place at the center section of the grinding disk by rotating the shaft halves holding the corrective lens and changing the relative distance between the axes of the shaft halves and of the grinding disk. The rotation of the corrective lens is interrupted when a measurement point is reached, the corrective lens is shifted axially relative to the grinding disk, away from the center section and toward the two edges of the grinding disk, until the forward and rearward faces at the circumference of the corrective lens make contact with the tracing device, the path or the time required to move from the center section to the point of contact with the measuring device is recorded, the measured values are stored in the computer, the shaft halves holding the corrective lens are rotated further and the circumference of the corrective lens is shaped until the next measurement point is reached. The rotation of the shaft halves holding the corrective lens is continued to record the measured values until at least one complete rotation of the shaft halves holding the corrective lens has been completed.

In contrast to the measurement procedure described in German patent specification 38 42 601, (U.S. Pat. No. 4,964,239) the measurement is effected in each case with the corrective lens held by the shaft halves and while not rotating, and the axial shift of the corrective lens relative to the grinding disk away from the center section and toward the two edges of the grinding disk until the forward and rearward faces at the circumference of the corrective lens make contact with the tracing device is effected during this period. This results in tracing the circumference of the corrective lens at discrete points which are less likely to be inaccurate either by rotation of the corrective lens or by the corrective lens circumference running onto the tracing stylus so that an area at the edge of the corrective lens which is at a distance from the prescribed measurement point makes contact with the tracing device.

With the measurement process which is the subject of the invention, it is possible to identify prior to the commencement of shaping, characteristic measurement points at the circumference of the corrective lens taking into account the selected corrective lens shape and the optical and decentration values for the corrective lens and when doing so to limit this to six to ten measurement points. The measurement points can preferably be located near cusps at the circumference of the corrective lens, determined by the computer in dependency on the selected corrective lens shape and the optical and decentration values for the corrective lens utilizing the grinding program by means of which the grinding procedure is appropriately controlled.

The measured values recorded in this way during the course of grinding the circumference can be used by the computer to optimize the course of a bevel or groove to be ground at the circumference of the corrective lens so that the grinding of the bevel or groove can be effected without difficulties under computer control by the corrective lens edge grinding machine using a grinding disk with a suitable profile at its circumference. Optimizing the course of the groove is always of advantage when dealing with lenses with high positive diopter values and/or circumference contours which greatly deviate from a circular shape. In the case of lenses with high negative diopter values, one attempts to have the bevel or groove run near the forward face of the corrective lens in order to avoid an aesthetically unfavorable overhang of the forward face of the corrective lens beyond the eyeglass frame. In the case of corrective lenses with high positive diopter values, the course of the bevel or groove must be optimized to avoid exiting of the bevel or groove from the circumferential surface of the corrective lens between the three-dimensional curves at the forward and rearward faces, in which case the bevel or circumferential groove would be interrupted.

Other features and advantages of the present invention will become apparent from the following description of the invention which refers to the accompanying drawings.

BRIEF DESCRIPTION OF THE DRAWINGS

The invention is described in detail below on the basis of an exemplary embodiment illustrated in the drawings. Shown in the drawings are.

DETAILED DESCRIPTION OF THE INVENTION

Figure 2:
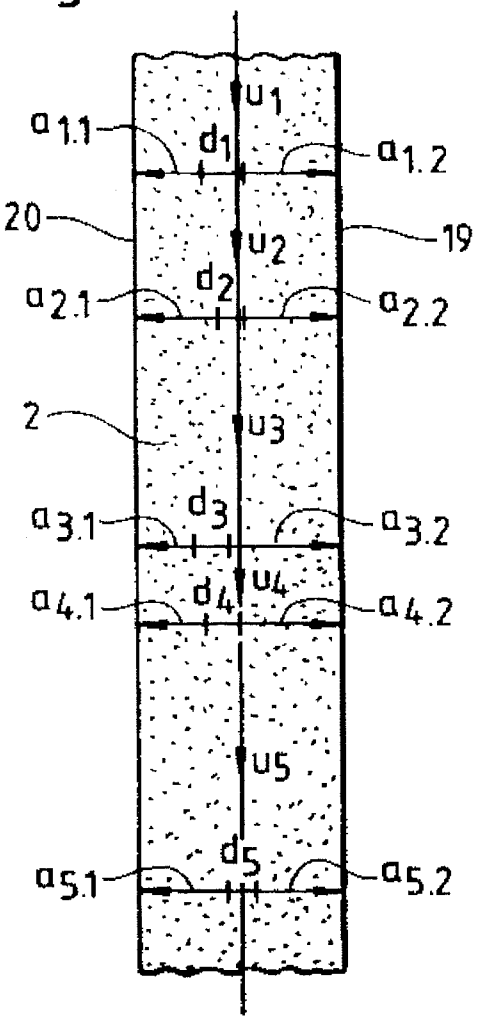
FIG. 2 a schematic representation of the path described by the contact point between the corrective lens and the grinding disk and the distance from this point to the reference line (center line of the grinding disk).
Figure 1:
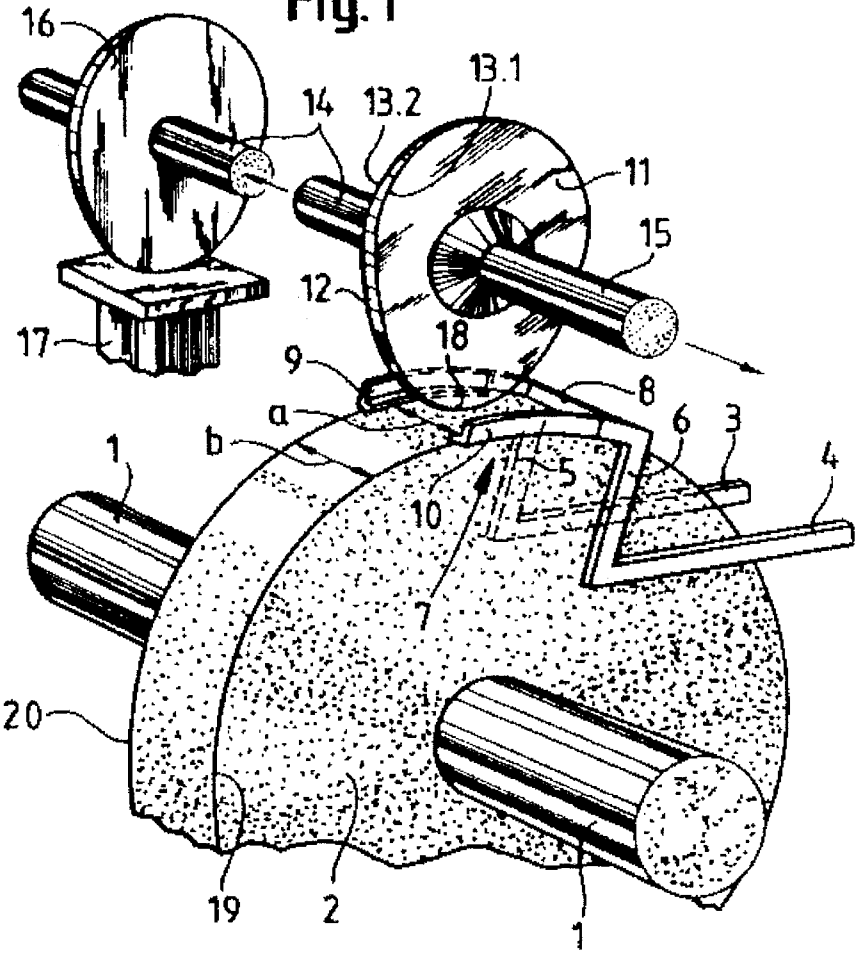
FIG. 1 a perspective view of the top surface of a grinding disk with a tracing device located near it and with the corrective lens disposed above the grinding disk.

With reference now to the drawings, shaft 1 which is mounted so as to be rotatable and possibly axially shiftable carries a grinding disk 2 mounted in a fashion preventing rotation relative to the shaft and places the grinding disk 2 in rotary motion. Provided at both sides of the grinding disk 2 and mounted on a wall of the machinery housing not illustrated are two parallel carrier strips 3, 4 which verge approximately perpendicularly into further carrier strips 5, 6. Located at the end of this second pair of carrier strips 5, 6 is a fork-shaped tracing device 7 comprising a crossbar 8 and two parallel fork arms 9, 10 which are positioned at a distance one to the other corresponding approximately to the width of the grinding disk 2. The fork arms 9, 10 may be shaped so as to approximate the arc along the circumference of the grinding disk.

A corrective lens 11 is held in a known manner between and rotated slowly by two halves of a shaft 14, 15 in the machine. A template 16 or a circular disk is mounted on the one half of the shaft 14 in a way so as to prevent rotation relative to the shaft 14 and to rest on a support 17. Since the corrective lens edge grinding machine is preferably computer controlled, the support 17 can be moved upward and downward by the machine control device in accordance with the pre-selected shape of the corrective lens. In this case a circular template 16 will have to be used so as to transfer the motion of the support 17 to the corrective lens 11. The circumference 12 of the corrective lens 11 rests on the grinding disk 2 and rotates slowly while grinding disk 2 rotating at higher speed contour-grinds the circumference of the corrective lens either in accordance with a pre-selected template 16 or following a contour specified by the computer and replicated by the motion of the support 17. The corrective lens is ground at the center section of the grinding disk 2, between the edges of the grinding disk 19, 20. Here the corrective lens 11 touches the grinding disk at one contact point 18. This contact point 18 is defined as a pre-determined measurement point at which the rotation of the corrective lens 11 is stopped and the corrective lens 11 is shifted axially relative to the grinding disk 2. This axial shift is executed to either side, in the direction of the edges of the grinding disk 19, 20, until contact is made with the fork arms 9, 10. Upon contact with the one and the other of the fork arms 9, 10, an electrical signal is forwarded to the machine control device and/or the computer which will cause the direction of shift to be reversed, toward the center of the grinding disk and the distance covered to be measured.

Represented in FIG. 2 are the course of contour-grinding the circumference of the corrective lens 11 and the tracing of the three-dimensional curves and the thickness of the ground circumference of the corrective lens. The corrective lens 11 is rotated slowly by the halves of the shaft 14, 15 and covers thus a path corresponding to a section of the circumference $u_1$. The rotation of the halves of the shaft 14, 15 and of the corrective lens 11 is now stopped. While the corrective lens 11 is at a standstill it is shifted relative to the grinding disk 2, toward the edges of the grinding disk 19, 20. It is assumed that the corrective lens 11 exhibits a thickness of $d_1$ at this point and exhibits a position relative to the center plane of the grinding disk 2 as shown. Thus a distance of $a_{1.1}$ will be covered up to the point at which the rear face 13.2 of the corrective lens 11 near the circumference 12 of the corrective lens touches the fork arm 9. The contact with the fork arm 9 will cause the relative axial motion between the corrective lens 11 and the grinding disk 2 to be reversed and continue until the forward face 13.1 of the corrective lens 11 near the circumference 12 of the corrective lens touches the fork arm 10. In response, the axial movement will again be reversed and continued until the corrective lens 11 has again reached its center position in reference to the center plane of the grinding disk 2. Now the corrective lens 11 held by the halves of a shaft 14, 15 will again be placed in slow rotation which is continued until a distance corresponding to circumference section $u_2$ has been covered, at which point the axial shift with simultaneous measurement of the excursion paths $a_{2.1}$ and $a_{2.2}$ will be repeated, whereby paths $a_{1.1}$ and $a_{1.2'}$ will differ from the values at the foregoing measurement point due to the differing thickness $d_2$ of the corrective lens at this measurement point and the relative locations of the forward face 13.1 and the rearward face 13.2. If the wearing away of the edge of the corrective lens 11 is continued in this manner until the corrective lens 11 has executed at least one full revolution, then the contour at the circumference of the corrective lens will have been completed in accordance with control by the template 16 or the support 17 and value pairs $a_{1.1}$, $a_{1.2}$, $a_{2.1}$, $a_{2.2}$, etc. are stored at the computer. The computer will calculate on the basis of these value pairs the thickness $d_1$, $d_2$ of the corrective lens at each position and the course of the three-dimensional curves at the forward face 13.1 and the rearward face 13.2 of the corrective lens.

The circumferential sections $u_1$, $u_2$, etc. may differ in length although the rotation angles for the corrective lens 11 are constant or may exhibit equal or differing lengths with varying angles of rotation for the corrective lens 11. The angle through which the corrective lens 11 must be rotated before a new measurement is made will depend on the corrective lens to be ground, the contour and the optical and decentration values for the corrective lens, which are entered in the computer prior to grinding the circumference of the lens. If it is suitably programmed, the computer can then calculate the characteristic measurement points along the circumference of the corrective lens and control the eyeglass lens edge grinding machine accordingly.

During the grinding procedure for the circumferential contour of the corrective lens 11 by means of stepwise rotation of the halves of a shaft 14, 15 through an angle of 5° in each step, for example, so that the grinding process is completed after seventy-two steps, it will be sufficient to specify six to ten measurement points to measure the three-dimensional curves at the forward face 13.1 and the rearward face 13.2 of the corrective lens 11 and the corresponding thickness of the lens; the number and location of the points will depend on the shape of the corrective lens selected and the optical and decentration values for the corrective lens. Since the corrective lens 11 does not rotate during the measurement procedure, contact will be made between the corrective lens 11 and the fork arms 9, 10 at only a single point, in an area near the contact point 18, so that there is no reason for inaccuracy of the measured values due to severe concavity of the corrective lenses, which may be encountered particularly in the case of very thick lenses. Also, errors will not arise due to a circumferential section of the corrective lens 11 contacting one of the fork arms 9, 10 in an area which is distant from the contact point 18.

The values for the three-dimensional curves and the lens thickness thus obtained are used to conduct subsequent, computer-controlled and optimized grinding of a bevel or groove, not described in detail here.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A process for measuring forward and rearward three-dimensional curves and thicknesses of a corrective lens during contour-grinding of the circumference of the corrective lens by a grinding disk, the process comprising the steps of:

rotating the corrective lens with respect to the grinding disk;

interrupting and stopping relative rotation of the corrective lens during contour-grinding at measurement points defining pre-determinable angular intervals;

shifting the corrective lens axially relative to the grinding disk at the measurement points while the relative rotation of the corrective lens has been stopped; and determining the location of the forward and rearward three-dimensional curves and the thickness of the lens at the measurement points, by recording at least one of an excursion distance and a time required for shifting.

2. The process according to claim 1, wherein the angular spacing of the measurement points at the circumference of the lens is specified prior to the commencement of contour grinding in accordance with the shape of the lens selected and the optical and decentration values for the lens.

3. The process according to claim 2, further comprising determining the number of measurement points in dependency on the shape of the corrective lens selected and on the optical and decentration values for the corrective lens.

4. The grinding process according to claim 3, wherein the measurement points are located near cusps along the circumference of the corrective lens.

5. The process according to claim 1, further comprising using the measured values to grind a bevel or groove in the circumference of the corrective lens.

6. Apparatus for measuring the forward and rearward three-dimensional curves and thickness of a corrective lens during contour grinding of the circumference of the corrective lens by a grinding disk, the apparatus comprising:

means for holding and rotating the corrective lens with respect to the grinding disk so that the circumference of the corrective lens is ground by the disk;

means for interrupting and stopping relative rotation of the corrective lens during contour grinding by the grinding disk at measurement points defining predeterminable angular intervals;

means for shifting the corrective lens axially relative to the grinding disk at the measurement points while the relative rotation of the corrective lens has been stopped; and means for determining the location of the forward and rearward three-dimensional curves and thickness of the lens at the measurement points by recording at least one of an excursion distance and a time required for shifting.

7. The apparatus according to claim 6, wherein the angular spacing of the measurement points at the circumference of the lens is specified prior to the commencement of contour grinding in accordance with the shape of the lens selected and the optical and decentration values for the lens.

8. The apparatus according to claim 6, wherein the measurement points are located near cusps along the circumference of the corrective lens.

9. The apparatus according to claim 6, further comprising means for grinding a bevel or groove in the circumference of the corrective lens in dependence on the measured values.

* * * * *